US007785215B2

(12) United States Patent
Kohnen, II

(10) Patent No.: US 7,785,215 B2
(45) Date of Patent: Aug. 31, 2010

(54) GOLF BALL CONTAINING PHOTOLUMINESCENT MATERIAL AND A LIGHT SOURCE

(76) Inventor: Michael P. Kohnen, II, 401 Martin Ave. West, Turtle Lake, WI (US) 54889

( * ) Notice: Subject to any disclaimer, the term of this patent is extended or adjusted under 35 U.S.C. 154(b) by 399 days.

(21) Appl. No.: 11/982,483

(22) Filed: Nov. 1, 2007

(65) Prior Publication Data

US 2008/0108454 A1 May 8, 2008

Related U.S. Application Data

(60) Provisional application No. 60/856,760, filed on Nov. 6, 2006.

(51) Int. Cl.
*A63B 37/08* (2006.01)

(52) U.S. Cl. ..... 473/353

(58) Field of Classification Search ..... 473/353
See application file for complete search history.

(56) References Cited

U.S. PATENT DOCUMENTS 5,330,195 A * 7/1994 Gulick ..... 473/200
5,885,483 A 3/1999 Hao et al.
5,989,135 A * 11/1999 Welch ..... 473/353
6,375,864 B1 * 4/2002 Phillips et al. ..... 252/301.33
6,419,594 B1 * 7/2002 Nesbitt et al. ..... 473/371
6,712,487 B2 3/2004 Liou
2004/0266554 A1 * 12/2004 Park et al. ..... 473/353

* cited by examiner

*Primary Examiner*—Raeann Trimiew
(74) *Attorney, Agent, or Firm*—Tipton L. Randall

(57) ABSTRACT

A photoluminescent, light-emitting golf ball comprises a substantially solid core with an outer shell, both formed of a light transmissive material. Photoluminescent particles are distributed within the light transmissive material. A light-emitting circuit assembly embedded within the core includes at least one battery, a control circuit coupled to the at least one battery, a plurality of light-emitting diodes coupled to the control circuit, and an impact switch electrically connected between the battery and the control circuit. The control circuit actuates the light-emitting diodes for a predetermined time period in response to an impact of the golf ball by a golf club. Actuation of the light-emitting diodes by an impact on the golf ball excites the photoluminescent particles, causing the particles to glow in excess of the predetermined time period of actuation of the light-emitting diodes.

16 Claims, 4 Drawing Sheets

GOLF BALL CONTAINING PHOTOLUMINESCENT MATERIAL AND A LIGHT SOURCE

CROSS-REFERENCE TO RELATED APPLICATIONS, IF ANY

This application claims the benefit under 35 U.S.C. §119 (e) of co-pending provisional application Ser. No. 60/856,760, filed 6 Nov. 2006. Application Ser. No. 60/856,760 is hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a light-emitting golf ball and, more particularly, to a photoluminescent golf ball and, most particularly, to a photoluminescent golf ball having an internal light source.

2. Background Information

Golf is a popular, recreational pastime that is played all around the world. Because a round of golf requires several hours to play, only a limited number of players, termed golfers, can use a golf course during a day. Because the golf course requires the golfer to hit the golf ball relatively long distances, up to many hundreds of yards, it is important for the golfer to see the direction of the hole in order to hit the golf ball in that direction. Further, because there are both fairway and rough on a golf course, golfers must follow the flight of the struck ball to see where the ball lands. Consequently, golfing is generally limited to daytime play.

However, the great demand by the large number of golfers for playing time has prompted some golf courses to install lighting around the golf course to allow for golfing in twilight and into the night. Even the best lighting provides only marginal ability for the golfer to see the struck golf ball and determine the direction and distance the ball travels.

One attempt to overcome the difficulties of such "night golfing" involves providing a golf ball that emits light and, thus, is easier to find when golfing at night. In U.S. Pat. No. 6,712,487, Liou discloses a light-emitting golf ball that includes a plastic outer shell that admits light, a plastic core embedded in the outer shell, the plastic core admitting light, and a light-emitting circuit assembly embedded in the core. The light-emitting circuit assembly includes a battery, a plurality of LEDs, and an impact switch electrically connected between the battery and the LEDs and adapted to turn on the LEDs upon the ball being struck.

Upon being struck by, for example, a golf club, the impact switch actuates the LED's to flash for a selected period of time so the golfer can find the ball at night. The selected flash period is limited to relatively short duration in order to conserve the life of the battery and the useful life of the light-emitting golf ball. This short duration of emitting light is often insufficient for the golfer to locate the ball, particularly if the ball goes into the deep rough.

Thus, there is an unmet need for a light-emitting golf ball that emits light for an extended time period after being struck, without depleting the power source that provides the emitted light.

Applicant has invented a photoluminescent golf ball having an internal light source that overcomes the short comings of the above-mentioned light-emitting golf ball and provides a golf ball that emits light for an extended period of time.

SUMMARY OF THE INVENTION

The invention is directed to a photoluminescent, light-emitting golf ball. The golf ball comprises a substantially solid core formed of a light transmissive material, an outer shell formed of a light transmissive material surrounding the substantially solid core, and photoluminescent particles distributed within the light transmissive material. A light-emitting circuit assembly is embedded within the core. The light-emitting circuit assembly includes at least one battery, a control circuit coupled to the at least one battery, a plurality of light-emitting diodes coupled to the control circuit, and an impact switch electrically connected between the at least one battery and the control circuit. The control circuit actuates the light-emitting diodes for a predetermined time period in response to an impact of the golf ball by a golf club. Actuation of the light-emitting diodes by an impact on the golf ball excites the photoluminescent particles distributed within the light transmissive material, causing the particles to glow in excess of the predetermined time period of actuation of the light-emitting diodes.

In a preferred embodiment of the invention, the photoluminescent particles are distributed only in the outer shell of the golf ball and the light-emitting circuit assembly includes a plurality of batteries.

DESCRIPTION OF THE EMBODIMENTS

| Nomenclature | |
|---|---|
| 10 | Photoluminescent Light-emitting Golf Ball |
| 15 | Solid Core of Ball |
| 20 | Outer Shell of Ball |
| 25 | Photoluminescent Particles |
| 30 | Light-emitting Circuit Assembly |
| 35 | Batteries |
| 40 | Light-emitting Diodes |
| 45 | Impact Switch |
| 46 | Metal Casing |
| 47 | Metal Spring |
| 48 | Conductor |
| 49 | Insulating Pad |

-continued

| Nomenclature | |
|---|---|
| 50 | Conductor |
| 55 | Control Circuit |

Construction

The invention is a photoluminescent, light-emitting golf ball. The golf ball comprises a substantially solid core formed of a light transmissive material, an outer shell formed of a light transmissive material surrounding the substantially solid core, and photoluminescent particles distributed within the light transmissive material. A light-emitting circuit assembly is embedded within the core. The light-emitting circuit assembly includes at least one battery, a control circuit coupled to the at least one battery, a plurality of light-emitting diodes coupled to the control circuit, and an impact switch electrically connected between the at least one battery and the control circuit. The control circuit actuates the light-emitting diodes for a predetermined time period in response to an impact of the golf ball by a golf club. Actuation of the light-emitting diodes by an impact on the golf ball excites the photoluminescent particles distributed within the light transmissive material, causing the particles to glow in excess of the predetermined time period of actuation of the light-emitting diodes.

Figure 3:
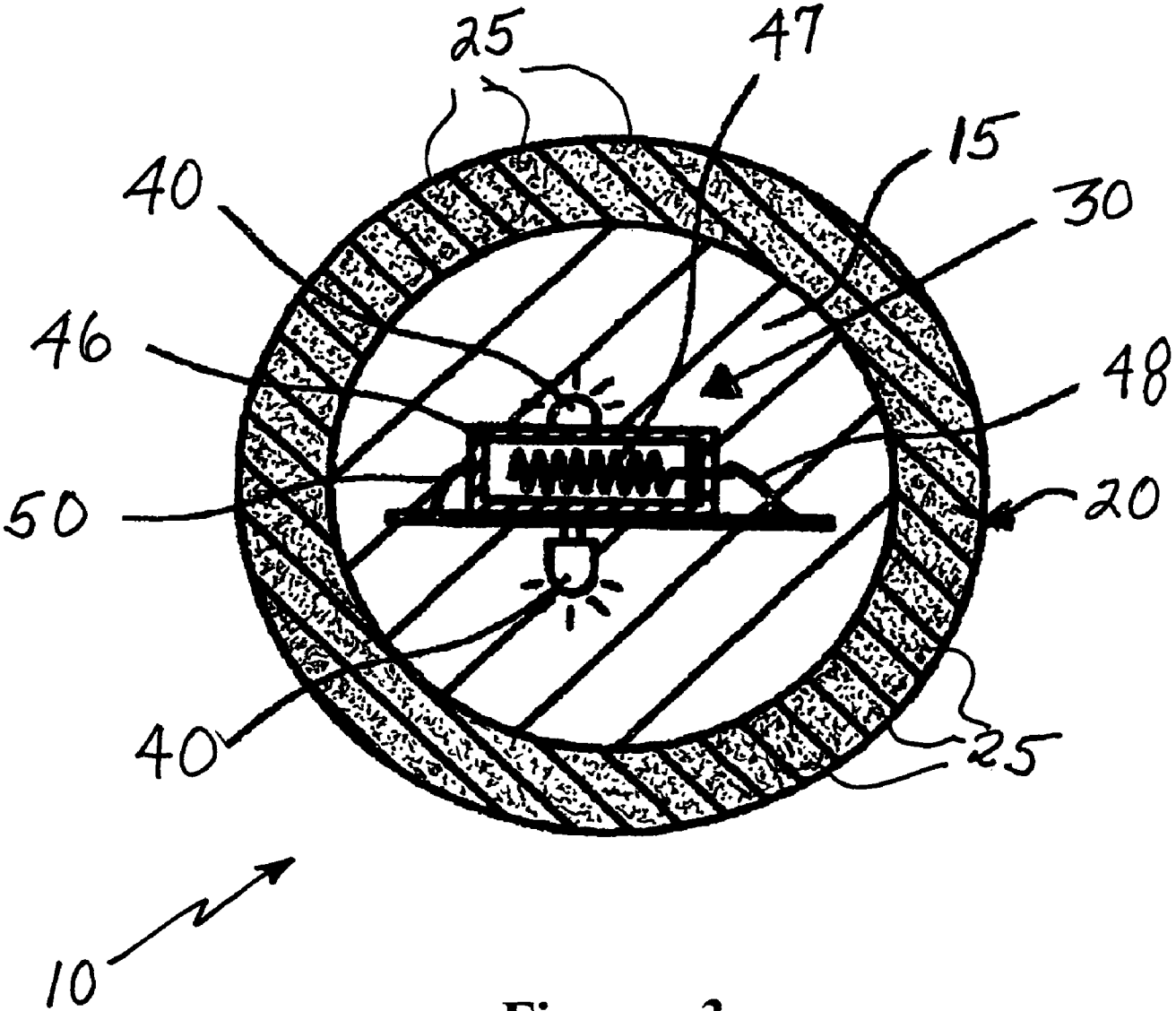
FIG. 3 is a cross sectional view of a preferred embodiment of the photoluminescent, light-emitting golf ball of the present invention.

Referring to the FIGS., a photoluminescent, light-emitting golf ball 10 is shown. The golf ball 10 is comprised of a solid core 15 of light transmissive material, and an outer shell 20 of light transmissive material surrounding the core 15. Photoluminescent particles 25 are distributed within the light transmissive material. The photoluminescent particles 25 may be distributed in the solid core 15 and/or the outer shell 20. Preferably, the photoluminescent particles 25 are distributed in the outer shell 20, as illustrated in FIG. 3. The solid core 15 and the outer shell 20 are fabricated from polymeric resin material for strength and durability, as well as being transmissive to visible light. Preferably, the core 15 is composed of polyurethane C polymer, while the outer shell 20 is composed of polyurethane polymer, both available from a number of commercial sources.

In a preferred embodiment, the ratio of photoluminescent particles 25 to polyurethane polymer in the outer shell 20 is about 1:3. In a most preferred embodiment of the invention, the ratio of photoluminescent particles 25 to polyurethane polymer in the outer shell 20 is about 1:1. The higher concentration of photoluminescent particles 25 in the outer shell 20 provides a much higher exterior luminosity following exposure of the photoluminescent particles 25 to a light source interior the golf ball 10.

Figure 1:
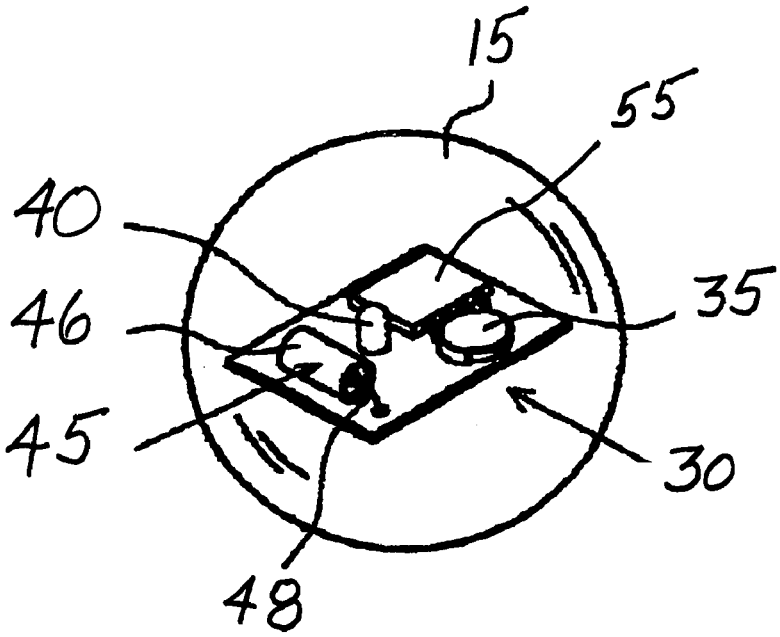
FIG. 1 is a perspective view of the solid core of the golf ball of the present invention.
Figure 2:
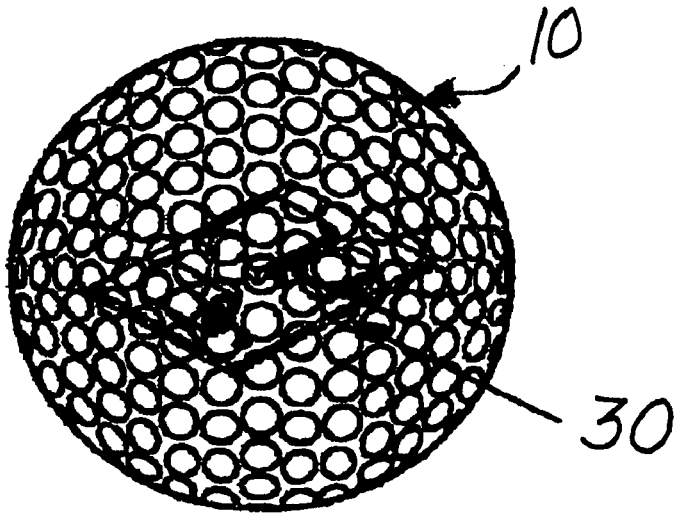
FIG. 2 is a perspective view of the photoluminescent, light-emitting golf ball of the present invention.

A light-emitting circuit assembly 30 is embedded within the solid core 15, as illustrated in FIGS. 1-3. The light-emitting circuit assembly 30 includes at least one battery 35 that provides the necessary working voltage for the circuit assembly 30. Preferably, the circuit assembly 30 includes a plurality of batteries for reasons described below. A plurality of LEDs (light-emitting diodes) 40 are present in the circuit assembly 30, and an impact switch 45 is electrically connected between the at least one battery 35 and the LEDs 40. Also included in the light-emitting circuit assembly 30 is a control circuit 55 for regulating the function of the circuit assembly 30.

Figure 4:
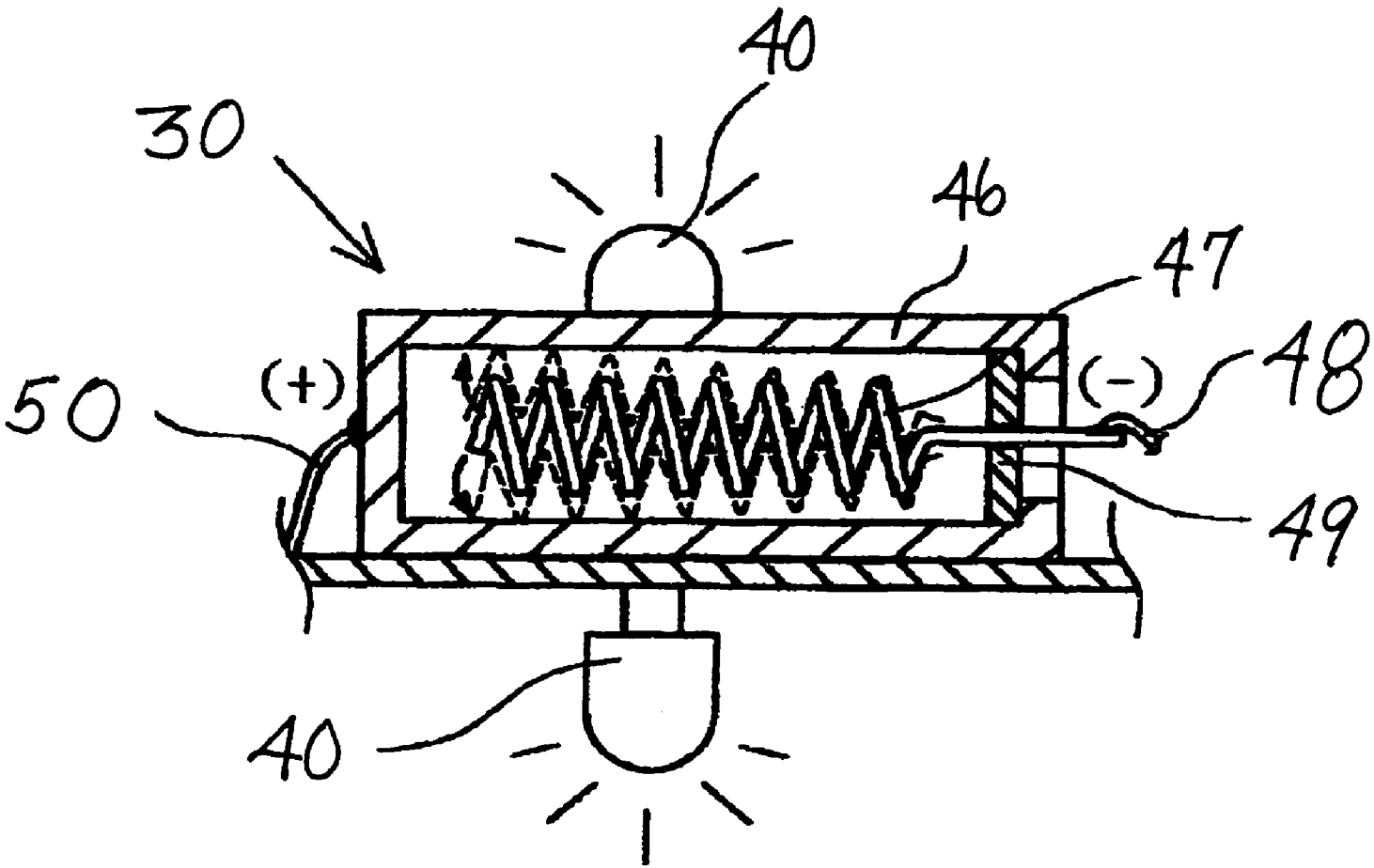
FIG. 4 is a cross sectional view of one embodiment of the impact switch of the photoluminescent, light-emitting golf ball of the present invention.
Figure 5:
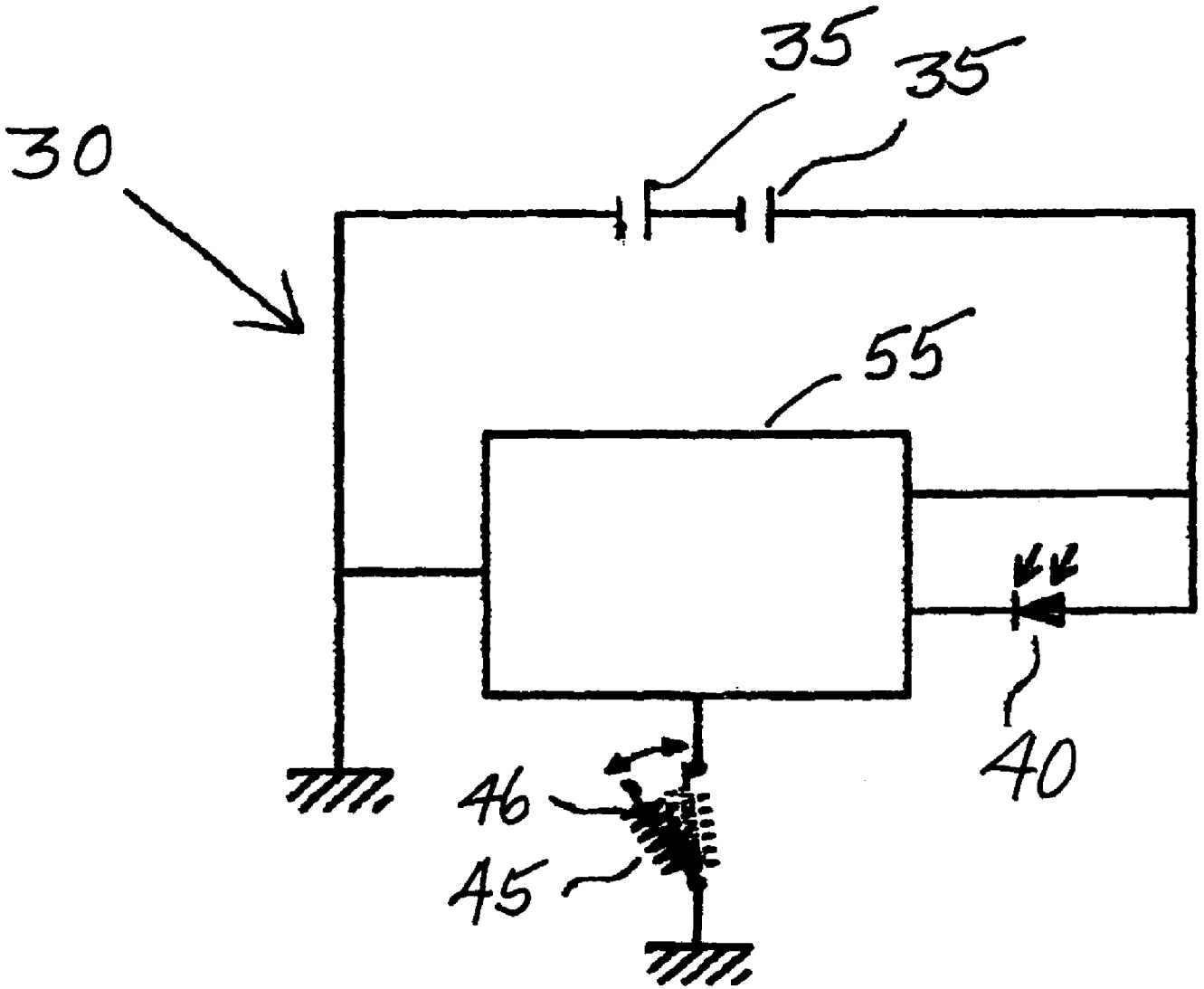
FIG. 5 is a schematic diagram of one embodiment of the light-emitting circuit assembly of the present invention.

In one embodiment of the invention, the impact switch 45 is comprised of a metal casing 46 and a metal spring 47, as illustrated in FIG. 4. The metal casing 46 is connected to one terminal, for example, the positive terminal of the at least one battery 35 by a conductor 48. The metal spring 47 is suspended inside the metal casing 46 having one end inserted through an electrically insulating pad 49 in the metal casing 46 and connected to the other terminal, the negative terminal of the at least one battery 35, by another conductor 50.

Referring now to FIGS. 3 and 4, when carrying the photoluminescent, light-emitting golf ball 10 or holding it with the hand, the vibration force is insufficient to vibrate the metal spring 47 violently. Under these conditions, the metal spring 47 does not touch the metal casing 46, and therefore the impact switch 45 is off. When the golfer hits the photoluminescent, light-emitting golf ball 10 with a golf club, the heavy impact forces the metal spring 47 to vibrate violently, thereby causing the metal spring 47 to contact the inside wall of the metal casing 46 intermittently. When the metal spring 47 touches the inside wall of the metal casing 47, the impact switch 45 becomes electrically conductive and triggers the control circuit 55 of the light-emitting circuit assembly 30, causing the control circuit 55 of the light-emitting circuit assembly 30 to actuate the LEDs 40 subject to a predetermined operating mode for a predetermined length of time. The operating mode of the LEDs 40 can include continuous lighting or intermittent lighting, both for a predetermined length of time.

When driving the photoluminescent, light-emitting golf ball 10 into the air in the night, the photoluminescent, light-emitting golf ball 10 can emit a continuous light or intermittent flashes of light, depending upon the program contained in the control circuit 55. Additionally, the emitted light of the LEDs 40 also excites the photoluminescent particles 25 distributed within the light transmissive material of the golf ball 10, causing the photoluminescent particles 25 to glow. The photoluminescent particles 25 are of a composition that continues to emit visible light for an extended period of time, in excess of the predetermined time period of actuation of the LEDs 40.

The photoluminescent particles 25, according to the preferred embodiment of the invention, have the general formula: $MO.(n-x)\{aAl_2O_3^{\alpha}+(1-a)Al_2O_3^{\gamma}\}.xB_2O_3:R$, where M is any alkaline earth metal preferably selected from among Sr, Ca and Ba, and R is a rare earth element selected from La, Ce, Pr, Nd, Sm, Gd, Tb, Dy, Ho, Er, Tm, Yb, Lu, Mn and Bi. The photoluminescent particles 25 are available from Qinglong Hao, 45 Yili, Zhujiafedn, Fengtai District, Beijing 100074, China. The preparation of this class of photoluminescent particles 25 is disclosed in U.S. Pat. No. 5,885,483, and the contents of this reference is incorporated herein. Most preferably, the photoluminescent particles 25 of the present invention contain strontium aluminate borate.

Because the control circuit 55 of the light-emitting circuit assembly 30 controls the LEDs 40 to flash intermittently, or to continuously emit light, for a predetermined length of time when triggered by the impact switch 45, the golfer can see the direction of travel of the photoluminescent, light-emitting golf ball 10 in low light conditions or in the dark. Since the duration of flight of a golf ball is seldom more than ten (10) seconds, the predetermined length of time of actuation of the LED's 40 needs to be no more that this value. However, the deactivation of the LED's 40 by the control circuit 55 does not assist the golfer in locating the golf ball 10 after this time period. The golfer, of course, must traverse the distance the golf ball 10 traveled to locate the golf ball 10, which requires several minutes. It is the glowing photoluminescent particles 25 contained in the transmissive material of the photoluminescent, light-emitting golf ball 10 that provides the golfer with assistance in locating the golf ball 10 in low light conditions. The photoluminescent particles 25 are positioned in close proximity to the LED's 40 and activated by the light emitted by the LED's 40 during the flight of the golf ball 10. Consequently, the service life of the at least one battery 35 is extended by the limitation of activating the LEDs 40 for only short time periods. In addition, a preferred embodiment of the invention includes a plurality of batteries 35 contained in the light-emitting circuit assembly 30, shown in the schematic diagram of the light-emitting circuit assembly 30 of FIG. 4. The plurality of batteries 35 provides extended life for the light-emitting circuit assembly 30 embedded in the core 15, and extends the useful life of the photoluminescent, light-emitting golf ball 10.

Further, the outer shell 20 and the core 15 are made of polymeric resin materials that provide sufficient resilient strength and meet standard golf specification requirements. The exterior surface of the outer shell 20 is covered by dimples (FIG. 2), as is standard for all golf balls. Because the light-emitting circuit assembly 30 is embedded in the core 15 by being molded therein, it is positively positioned in the photoluminescent, light-emitting golf ball 10. Impact of the photoluminescent, light-emitting golf ball 10 by a golf club does not cause the light-emitting circuit assembly 30 to displace.

While the invention has been particularly shown and described with reference to preferred embodiments thereof, it will be understood by those skilled in the art that various changes in form and details may be made therein without departing from the spirit and scope of the invention.

I claim:

1. A photoluminescent, light-emitting golf ball comprising;

a substantially solid core formed of a light transmissive material;

an outer shell formed of a light transmissive material surrounding the substantially solid core;

photoluminescent particles distributed only within the light transmissive material of the outer shell, the ratio of photoluminescent particles to light transmissive material in the outer shell between about 1:3 and 1:1; and a light-emitting circuit assembly embedded within the core, the light-emitting circuit assembly including at least one battery, a control circuit coupled to the at least one battery, a plurality of light-emitting diodes coupled to the control circuit, and an impact switch electrically connected between the at least one battery and the control circuit to actuate the light-emitting diodes for a predetermined time period responsive to an impact of the golf ball by a golf club;

whereby actuation of the light-emitting diodes by an impact on the golf ball excites the photoluminescent particles distributed within the light transmissive material, causing the particles to glow in excess of the predetermined time period of actuation of the light-emitting diodes.

2. The photoluminescent, light-emitting golf ball of claim 1, wherein the light-emitting circuit assembly includes a plurality of batteries.

3. The photoluminescent, light-emitting golf ball of claim 1, wherein the impact switch including a metal casing connected to a terminal of the control circuit, and a metal spring suspended in the metal casing and electrically connected to one terminal of the at least one battery, the metal spring being adapted to vibrate sufficiently to contact the metal casing responsive to the golf ball being struck by a golf club.

4. The photoluminescent, light-emitting golfball of claim 1, wherein the light transmissive material includes polyurethane resins.

5. The photoluminescent, light-emitting golfball of claim 1, wherein the photoluminescent particles have the formula: $MO.(n\text{-}x)\{aAl_2O_3^{\alpha}+(1\text{-}a)Al_2O_3^{\gamma}\}.xB_2O_3$: R, wherein M is any alkaline earth metal selected from the group consisting of Sr, Ca and Ba; and R is a rare earth element selected from the group consisting of La, Ce, Pr, Nd, Sm, Gd, Tb, Dy, Ho, Er, Tm, Yb, Lu, Mn and Bi.

6. The photoluminescent, light-emitting golf ball of claim 5, wherein the photoluminescent particles contain strontium aluminate borate.

7. A photoluminescent, light-emitting golf ball comprising;

a substantially solid core formed of a light transmissive material;

an outer shell, formed of a light transmissive material surrounding the substantially solid core;

photoluminescent particles distributed within the light transmissive material of the outer shell, the ratio of photoluminescent particles to light transmissive material in the outer shell between about 1:3 and 1:1; and a light-emitting circuit assembly embedded within the core, the light-emitting circuit assembly including at least one battery, a control circuit coupled to the at least one battery, a plurality of light-emitting diodes coupled to the control circuit, and an impact switch electrically connected between the at least one battery and the control circuit to actuate the light-emitting diodes for a predetermined time period responsive to an impact of the golf ball by a golf club;

whereby actuation of the light-emitting diodes by an impact on the golf ball excites the photoluminescent particles distributed within the light transmissive material, causing the particles to glow in excess of the predetermined time period of actuation of the light-emitting diodes.

8. The photoluminescent, light-emitting golf ball of claim 7, wherein the light-emitting circuit assembly includes a plurality of batteries.

9. The photoluminescent, light-emitting golf ball of claim 7, wherein the impact switch including a metal casing connected to a terminal of the control circuit, and a metal spring suspended in the metal casing and electrically connected to one terminal of the at least one battery, the metal spring being adapted to vibrate sufficiently to contact the metal casing responsive to the golf ball being struck by a golf club.

10. The photoluminescent, light-emitting golf ball of claim 7, wherein the light transmissive material includes polyurethane resins.

11. The photoluminescent, light-emitting golf ball of claim 7, wherein the photoluminescent particles have the formula: $MO.(n\text{-}x)\{aAl_2O_3^{\alpha}+(1\text{-}a)Al_2O_3^{\gamma}\}.xB_2O_3$: R, wherein M is any alkaline earth metal selected from the group consisting of Sr, Ca and Ba; and R is a rare earth element selected from the group consisting of La, Ce, Pr, Nd, Sm, Gd, Tb, Dy, Ho, Er, Tm, Yb, Lu, Mn and Bi.

12. The photoluminescent, light-emitting golf ball of claim 11, wherein the photoluminescent particles contain strontium aluminate borate.

13. A photoluminescent, light-emitting golf ball comprising;

a substantially solid core formed of a light transmissive material;

an outer shell formed of a light transmissive material surrounding the substantially solid core;

photoluminescent particles distributed within the light transmissive material of the outer shell, the ratio of photoluminescent particles to light transmissive material in the outer shell between about 1:3 and 1:1; and a light-emitting circuit assembly embedded within the core, the light-emitting circuit assembly including a plurality of batteries, a control circuit coupled to the plurality of batteries, a plurality of light-emitting diodes coupled to the control circuit, and an impact switch electrically connected between the plurality of batteries and the control circuit to actuate the light-emitting diodes for a predetermined time period responsive to an impact of the golf ball by a golf club, the impact switch including a metal casing connected to a terminal of the control circuit, and a metal spring suspended in the metal casing and electrically connected to one terminal of the plurality of batteries, the metal spring being adapted to vibrate sufficiently to contact the metal casing responsive to the golf ball being struck by a golf club;

whereby actuation of the light-emitting diodes by an impact on the golf ball excites the photoluminescent particles distributed within the light transmissive material, causing the particles to glow in excess of the predetermined time period of actuation of the light-emitting diodes.

14. The photoluminescent, light-emitting golf ball of claim 13, wherein the light transmissive material includes polyurethane resins.

15. The photoluminescent, light-emitting golf ball of claim 13, wherein the photoluminescent particles have the formula: $MO.(n-x)\{aAl_2O_3^{\alpha}+(1-a)Al_2O_3^{\gamma}\}.xB_2O_3$: R, wherein M is any alkaline earth metal selected from the group consisting of Sr, Ca and Ba; and R is a rare earth element selected from the group consisting of La, Ce, Pr, Nd, Sm, Gd, Tb, Dy, Ho, Er, Tm, Yb, Lu, Mn and Bi.

16. The photoluminescent, light-emitting golf ball of claim 15, wherein the photoluminescent particles contain strontium aluminate borate.

* * * * *